United States Patent [19]

Ramsey, III

[11] Patent Number: 4,988,229

[45] Date of Patent: Jan. 29, 1991

[54] SINGLE HAND NOTEBOOK

[75] Inventor: Maynard Ramsey, III, Tampa, Fla.

[73] Assignee: Critikon, Inc., Tampa, Fla.

[21] Appl. No.: 353,268

[22] Filed: May 17, 1989

[51] Int. Cl.[5] ..... B42F 13/40

[52] U.S. Cl. ..... 402/4; 281/43; 281/45; 402/80 R

[58] Field of Search ..... 251/42, 45, 43, 44; 402/4, 80 R

[56] References Cited

U.S. PATENT DOCUMENTS

| | | | |
|---|---|---|---|
| 1,066,757 | 7/1913 | Rotzell | 402/4 |
| 1,397,645 | 11/1921 | McNeill et al. | 281/45 |
| 1,562,320 | 11/1925 | Farley | 281/43 |
| 2,211,879 | 8/1940 | Cave | 281/45 |
| 4,129,212 | 12/1978 | Hopkins | 402/77 X |
| 4,133,080 | 1/1979 | Kuk | 402/4 X |
| 4,284,220 | 8/1981 | Nice | 224/242 |
| 4,903,932 | 2/1990 | Stewart, Jr. | 281/45 X |

*Primary Examiner*—Paul A. Bell

*Attorney, Agent, or Firm*—Paul A. Coletti; W. Brinton Yorks, Jr.

[57] ABSTRACT

A looseleaf notebook is provided for retaining bar code listings which denote conditions of a patient in a hospital. The notebok includes a strap which encircles the binding of the notebook. Preferably this strap is fixed in place between the notebook ring mechanism and the inside of the binding panel of the notebook. The strap is also preferably adjustable or resiliently stretchable. The strap permits the notebook to be held open and manipulated by a user who slides a hand between the strap and the binding panel while supporting the opened covers of the notebook with the thumb and fingers of the hand. With the notebook being held in one hand in this manner, the user's other hand is free to manipulate a bar code reader over the patient condition bar codes, or to perform other information-gathering or medical functions.

10 Claims, 3 Drawing Sheets

SINGLE HAND NOTEBOOK

This invention relates to notebooks which are to be used by medical personnel and, in particular, to notebooks which can be manipulated by such personnel with one hand, freeing the user's other hand to perform tasks related to use of the notebook.

In many institutions such as a hospital, personnel are called upon to perform numerous tasks while referencing printed material or books in which information is to be recorded. In hospital, for instance, medical personnel are frequently called upon to visit patients' rooms to record patient information or provide medical services to the patients. An efficient means for recording such patient information is through the use of a data recording system known at Vitalnet TM, which has been developed by Critikon, Inc. This system provides a central monitoring unit at a centrally located nurse's station, and remote data entry terminals located in the patients' rooms. The remote data entry terminals may be connected to automated instrumentation for the remote collection of information relating to patients' vital signs, such as automated blood pressure monitors. The remote terminals also provide a means for entering specific patient information into the system through keyboard and bar code reader devices.

To allow a systematic and unambiguous means for entering patient data, the Vitalnet TM system provides for the entry of specific codes for specific patient conditions and functions. The easiest way to enter the data without error is through the bar code reader. Each remote terminal is accompanied by a listing of specific patient conditions and functions encoded by the hospital with corresponding optically readable bar codes. To enter a bodily function such as "respiration", the user would find the word "respiration" in the listing and run the bar code reader over the bar code next to the word. "Respiration" would thereby be automatically and errorlessly entered into the system for that patient, and the user would then in a similar manner run the bar code reader over bar codes next to numbers to enter the numerical rate of the patient's respiration.

Because the remote terminals are conventionally mounted on a wall or stand next to a patient's bed, there is no desk or other workstation available for use when entering patient data from bedside. Accordingly, it is at times difficult for hospital personnel to manipulate the listings of patient conditions and the bar code reader while at the same time noting or measuring the patient's vital signs. Moreover, these tasks must usually be performed while standing. It would be desirable then to afford an easy means for the hospital personnel to perform these simultaneous tasks.

In accordance with the principles of the present invention, a looseleaf notebook is provided for retaining bar code listings which denote the condition of a patient in a hospital. The notebook includes a belt or strap which encircles the binding of the notebook. Preferably this strap is fixed in place between the notebook ring mechanism and the inside of the binding panel of the notebook. The strap is also preferably adjustable or resiliently stretchable. The strap permits the notebook to be held open and manipulated by a user who slides a hand between the strap and the binding panel while supporting the opened covers of the notebook with the thumb and fingers of the hand. With the notebook being held in one hand in this manner, the user's other hand is free to manipulate a bar code reader over the patient condition bar codes, or to perform other information-gathering or medical functions.

Figure 1:
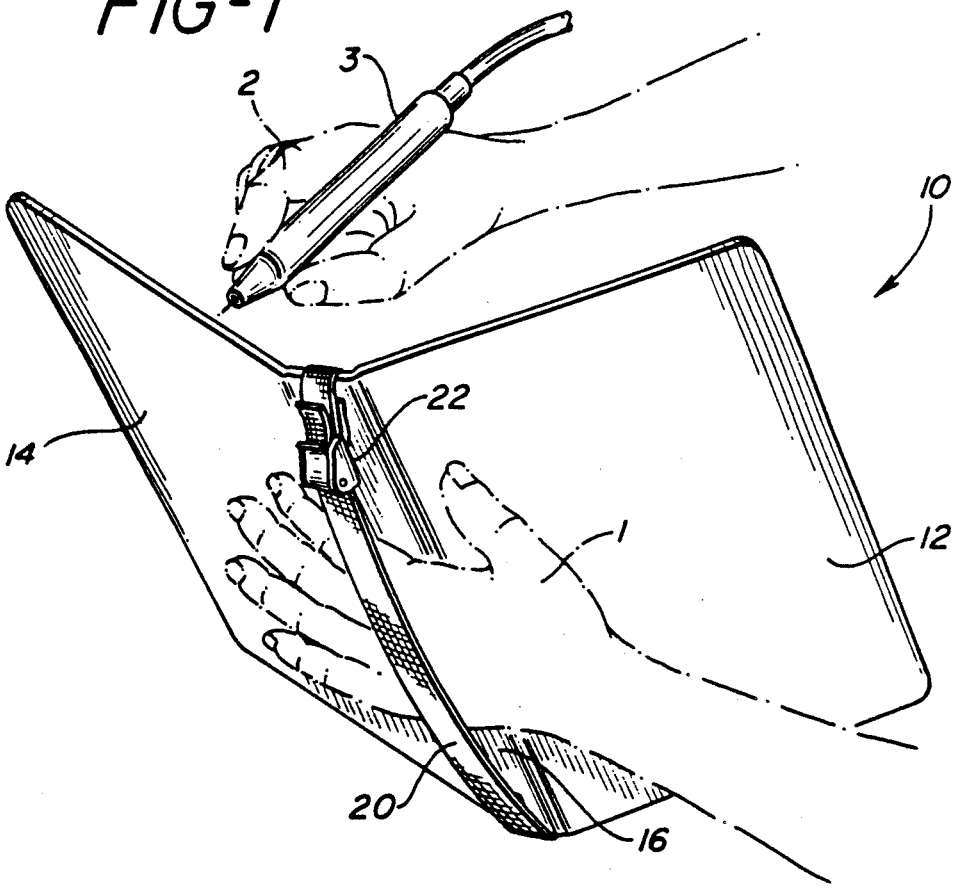
FIG. 1 illustrates a notebook of the present invention being held by one hand of a user while the other hand manipulates a bar code reader over the bar codes in the notebook.

Referring first to FIG. 1, a looseleaf notebook 10 of the present invention is shown in use. The notebook 10 has a front cover 12 and a back cover 14 which are joined by a binding panel 16. Wrapped around the binding panel 16 is an adjustable strap 20 with an adjustment clip 22. The strap 20 may be made of a cloth-like material such as nylon or rayon.

To use the notebook the user adjusts the adjustment clip so that the strap 20 is loose enough to slide one hand of the user between the strap 20 and the outside of the binding panel 16. The user then inserts one hand between the strap 20 and the binding panel 16 as shown in phantom in FIG. 1 by the hand 1 and opens the notebook . When the notebook is open the back cover 14 is supported by the fingers of the hand and the front cover 12 is supported by the thumb and the heel of the hand. The notebook is thus fully supported in the open condition with one hand, freeing the other hand 2 to manipulate a bar code reader 3 over the bar codes in the notebook, or to perform other functions.

Figure 2:
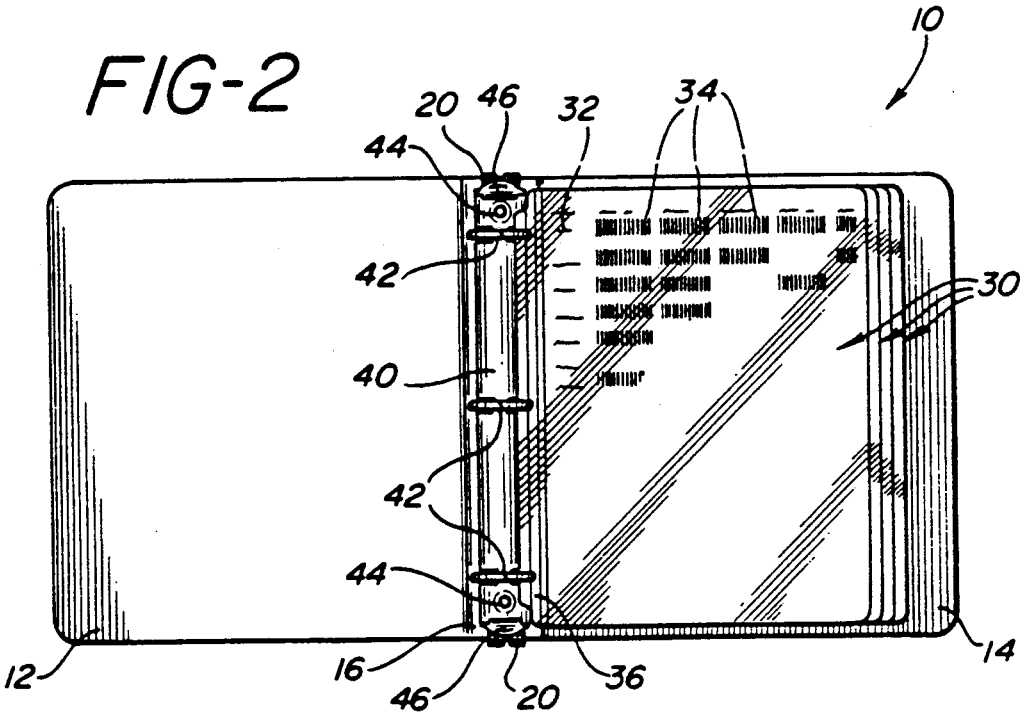
FIG. 2 illustrates the inside of the notebook of FIG. 1.

The inside of the notebook is shown in FIG. 2. A conventional three-ring notebook mechanism 40 is shown affixed to the inside of the binding panel 16 of the notebook, with the three rings shown at 42. The ring mechanism is riveted in place by two rivets 44, which pass through the ring mechanism 40, the strap 20, and the binding panel 16, thereby affixing the strap securely between the binding panel and the ring mechanism. The conventional end tabs 46 may be adjusted to open and close the rings 42 when inserting or removing pages 30 of the notebook. For use with the Vitalnet TM system, these pages 30 are held in the notebook inside three-ring transparent plastic protectors 36. The pages 30 contain listings of patient conditions printed in text as represented at 32. Next to the textual entries are printed bar codes for each patient condition as represented at 34. The pages 30 of text and bar codes are printed by the Vitalnet TM system in response to entries to a computer entered by an operator. The operator types the patient conditions into the computer, and the computer then automatically prints the textual patient condition and a corresponding bar code. This enables the hospital to prepare patient condition entries unique to the services it performs, with the patient condition listings being uniquely tailored to the conditions of its patients that the hospital desires to monitor and record. As described above, hospital personnel will simply turn to the page containing the patient condition to be recorded and runs the bar code reader over the corresponding bar code to enter the particular patient condition into the Vitalnet TM system.

Figure 3:
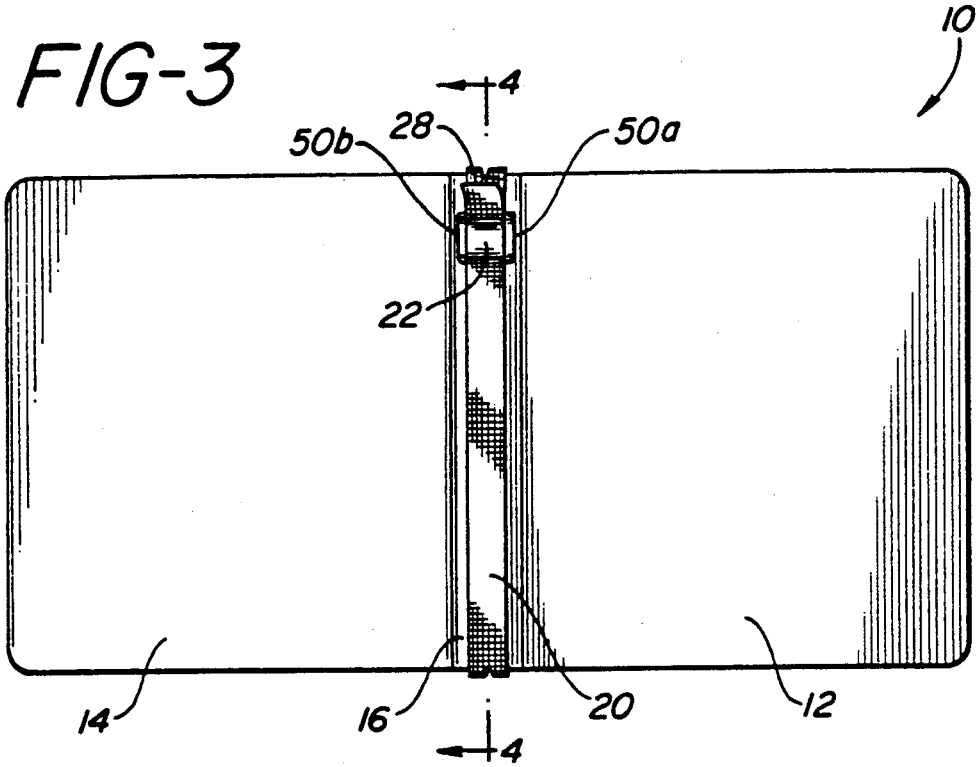
FIG. 3 is an illustration of the outside of the notebook of FIG. 2 showing the location of the adjustable strap.
Figure 4:
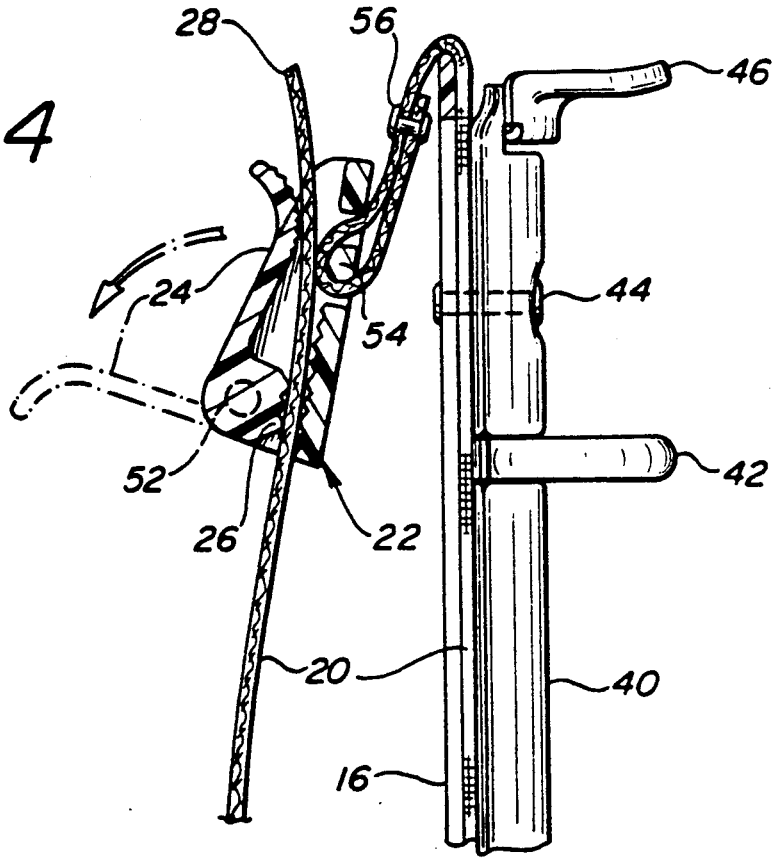
FIG. 4 is a cross-sectional view of the binding of the notebook of FIG. 3.

A plan view of the outside of a notebook of the present invention is shown in FIG. 3, with a cross-sectional view of the notebook binding shown in FIG. 4. These FIGURES show the strap 20 passing around the outside of the binding panel 16 with the strap adjustably closed by the adjustment clip 22. The adjustment clip 22 comprises a locking hinge 24 pivotally mounted on a pivot rod 52 between two end plates 50*a* and 50*b* of the clip. As FIG. 4 shows, one end of the strap 20 is looped around a fastening rod 54 of the clip and the end of the strap is pinned in place by a pin 56. The other end 28 of the strap passes between the locking hinge 24 and the other looped end of the strap. When the locking hinge 24 is pivoted upward as shown in the FIGURES the end 28 of the strap is secured in the clip by the compression of formed teeth 26 of the hinge against the strap material. The strap is adjusted by pivoting the locking hinge 24 downward as indicated by the arrow in FIG. 4 to release the end 28 of the strap from compression within the adjustment clip. In this way the strap 20 is easily adjusted to accommodate the hand of any user.

In an alternative embodiment it may be desirable to replace the nylon or rayon strap and adjustment clip with an elastic strap passing around the outside of the binding panel. The need for adjustment of the loop formed by the strap would be obviated as the strap would stretch to accommodate the hand of the user between the strap and the binding panel.

Figure 5:
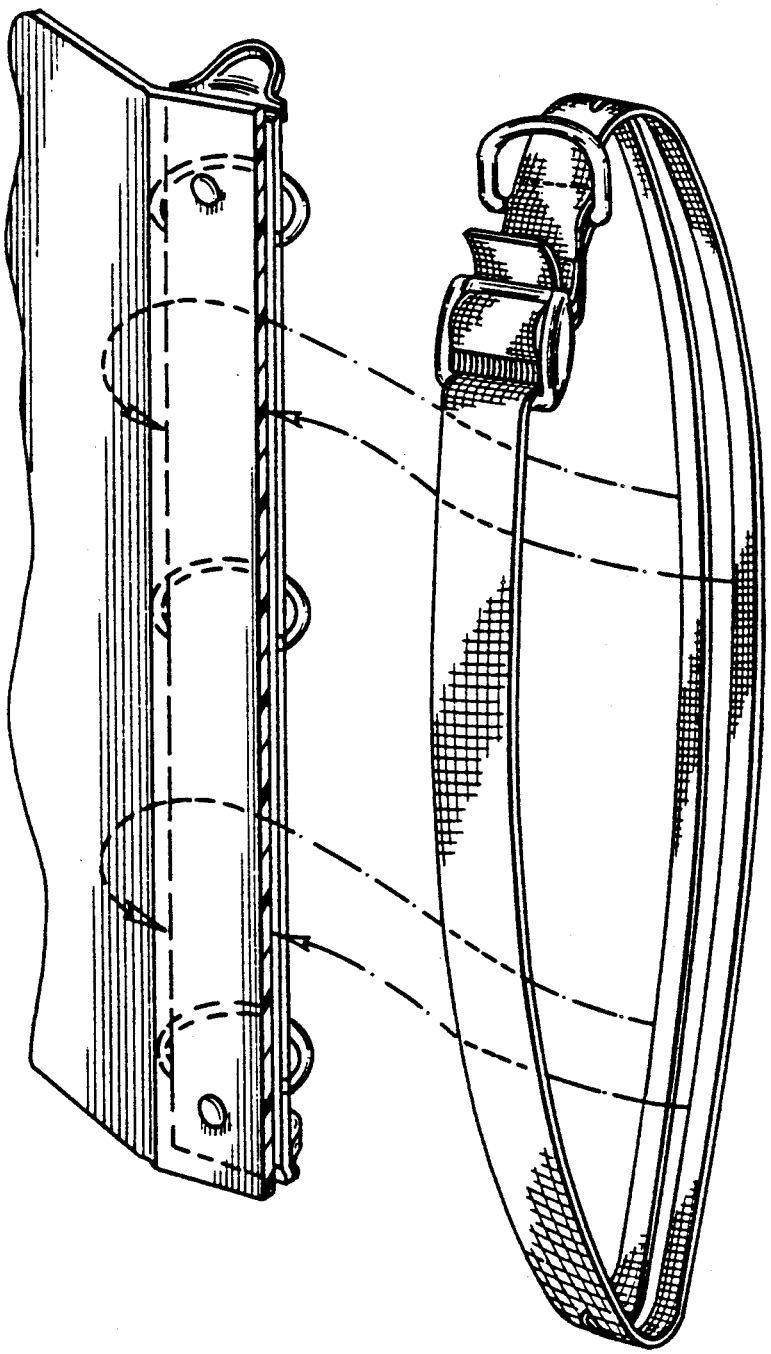
FIG. 5 illustrates a preferred embodiment of the strap, which may be adapted to an existing notebook.

FIG. 5 illustrates a preferred embodiment of the present invention in which the strap 60 is longitudinally split. An upper end of the strap 60 passes through a ring 66, around a central bar (not visible in the drawing) of a buckle 62, and back on itself. This end of the strap is then sewn on either side of the ring 66 as indicated at 67 to secure the ring to the strap. The ring 66 is thereby located at the top of the notebook binding, where it may be used to hang the notebook on a hook near its place of use.

The other end 61 of the strap 60 passes around the apex of a V-shaped lower bar 63 of the buckle, over the central bar, and under the upper bar 65 of the buckle, thereby closing the strap in an adjustable loop.

The strap 60 is also seen to have a longitudinal slit 70 extending from the top of the strap at 72 to the bottom at 74. The slit enables the strap 60 to be installed in any existing notebook. To do so, the slit portion of the strap is aligned over the notebook mechanism 40 on the inside of the notebook. The two slit sides of the strap are spread and each side of the strap slides between the notebook mechanism and and the binding panel of the notebook from a respective side of the mechanism, as indicated by the dashed and dotted arrows. The rivets 44 which secure the mechanism to the binding panel are thereby located in the slit 70, and each side of the strap is sandwiched between the mechanism and the binding panel. Thus, the strap 60 with its slit 70 can be looped over and installed in an existing notebook.

What is claimed is:

1. A notebook which may be manipulated in an open condition by one hand of a user comprising:
   - a front cover and a back cover joined by a binding panel;
   - means, connected to the inside of said binding panel, for retaining pages within the notebook;
   - a strap affixed to said binding panel and passing between said retaining means and said binding panel, said strap being continuously connectable around the outside of said binding panel,
   - whereby a hand of a user may be inserted between said strap and the outside of said binding panel to hold said notebook.

2. The notebook of claim 1, wherein said notebook is a looseleaf notebook, and said retaining means comprises and adjustable ring mechanism for retaining pages within said notebook by rings of said mechanism.

3. The notebook of claim 2, further comprising at least one page, located within said notebook, and containing optically scanable bar codes,
   - whereby said notebook may be held in an open position with one hand while said bar codes are scanned by a bar code reader held in the other hand.

4. The notebook of claim 2, wherein said strap passes between said ring mechanism and the inside of said binding panel, and said ring mechanism and strap are riveted to said binding panel.

5. The notebook of claim 1, wherein said strap includes an adjustment mechanism located on the continuously connectable portion of said strap, for adjusting the length of said continuously connectable portion of said strap.

6. The notebook of claim 1, wherein said strap is formed of a substantially inelastic cloth-like material.

7. The notebook of claim 1, wherein said strap is formed of an elastic material.

8. A strap for use with a looseleaf notebook including a mechanism for removably retaining pages within the notebook, said mechanism extending along a substantial length of the inside binding of the notebook, comprising: means for fastening said strap in an adjustable loop, said loop having an inside portion and an outside portion, and a longitudinal slit extending along a substantial length of the inside portion of said strap for dividing said inside portion into two separable sides which may be inserted between said mechanism and said inside binding of said notebook from opposite longitudinal sides of said mechanism.

9. The strap of claim 8, further comprising a ring fastened to said strap at a point on said strap which is near one end of said notebook mechanism.

10. The strap of claim 8, wherein said fastening means comprises a buckle.

* * * * *